US005954938A

United States Patent [19]

Takahashi et al.

[11] Patent Number: 5,954,938

[45] Date of Patent: Sep. 21, 1999

[54] SIMPLIFIED CATHODIC CORROSION PROTECTION METHOD AND APPARATUS FOR METAL STRUCTURE

[75] Inventors: Masahiro Takahashi, Tokyo; Yasuhiko Takahashi, Yokohama, both of Japan

[73] Assignee: TAC Corporation, Tokyo, Japan

[21] Appl. No.: 09/036,853

[22] Filed: Mar. 9, 1998

[30] Foreign Application Priority Data

Mar. 10, 1997 [JP] Japan ..... 9-054875

[51] Int. Cl.[6] ..... C23F 13/00

[52] U.S. Cl. ..... 205/724; 204/196.27; 204/196.26; 204/196.11

[58] Field of Search ..... 204/196.27, 196.26, 204/196.23, 196.19, 196.18, 196.17, 196.11; 205/727, 725, 726, 724

[56] References Cited

U.S. PATENT DOCUMENTS

H1644 5/1997 Muehl, Sr. ..... 204/196.27

5,139,634 8/1992 Carpenter et al. ..... 205/727

5,366,604 11/1994 Stilley ..... 204/196.27

OTHER PUBLICATIONS

Solarex Current, Energy for Oil and Gas, Why Would a Company with All the Energy it Needs Use Solar Power, Third Quarter, 1985, pp. 5–7. No month available.

*Primary Examiner*—Bruce F. Bell

*Attorney, Agent, or Firm*—Workman, Nydegger & Seeley

[57] ABSTRACT

Mounting an anode on a coated surface of a metal structure exposed to the atmosphere; connecting a cathode to a main body of the metal structure; connecting the anode and the cathode to a solar battery; whereby when a defective part is generated on the coated surface of the metal structure and water film is formed on the coated surface, establishing a corrosive condition of the metal structure, a current is automatically flowed between the anode and the cathode to prevent corrosion of the metal structure.

10 Claims, 4 Drawing Sheets

SIMPLIFIED CATHODIC CORROSION PROTECTION METHOD AND APPARATUS FOR METAL STRUCTURE

This application is based on patent application Ser. No. 54,875/1997 filed Mar. 10, 1997 in Japan, the content of which is-incorporated hereinto by reference.

BACKGROUND OF THE INVENTION

1. Field of the Invention

The present invention relates to a cathodic corrosion protection method and apparatus for electrically protecting a metal structure exposed to the atmosphere from being oxidized and corroded by electrolytic moisture and dissolved oxygen.

2. Description of the Prior Art

As a protective anode and cathodic corrosion protection system for corrosion protecting a coated surface of a metal structure exposed to the atmosphere, there is an apparatus which is developed and commercialized by C. L. I. Systems, Inc. (U.S.A.).

This corrosion protection apparatus provides an effect of corrosion protection of a metal structure which is exposed to the atmosphere and protected by coating, however, it inevitably has the following four problems. These problems are:

(1) output of a control unit is controlled to an optimum DC voltage and supplied to a plurality of anodes by wiring. However, due to differences in wiring distance of anode structure, voltage of each anode is not always an optimum value. Further, if the voltage is excessively high, there may be a problem of over-corrosion protection, and if the voltage is low, corrosion protection range is narrowed.

(2) While the control unit is inputted with AC 100V or AC 200V, for corrosion protection of a metal structure disposed in an explosion-proof area, the control unit and wiring are required to have explosion-proof specifications, which requires a special consideration in construction work and has a problem of sacrificed economy.

(3) There is a possibility of disconnection of the corrosion protection current due to open-circuit of wiring or the like.

(4) if there is no power supply of AC 100V or AC 200 V available in the vicinity, it is necessary to provide a power supply over a long distance.

SUMMARY OF THE INVENTION

With a view to obviate the above prior art problems, an object of the present invention is to provide a cathodic corrosion protection method and apparatus for a metal structure which requires no wiring work and can always maintain an optimum voltage.

For solving the above problems, the inventors have conducted the following experimental studies, and accomplished the present invention.

(i) The experiment has been carried out using measuring apparatus as shown in FIG. 1.

A solar battery 1 having an operation voltage of 7.5V and an operation current of 14.5 mA at a solar radiation amount of 100 mW/cm$^2$ is stuck to a coated steel plate 2 with an insulating adhesive 10. An aluminum-made anode 3 of 40 mm square is stuck in the vicinity of an end of the steel plate with the insulating adhesive 10, and an anode wire 1*a* of the solar battery 1 is connected to the anode 3. A cathode wire 1*b* of the solar battery 1 is connected to a base material of the coated steel plate 2.

Coating film of a part 2*a* at an end opposite to the anode mounting position of the coated steel plate is peeled to form an,artificial defective part 4 of 3 mm in diameter. The defective part 4 is provided with an Ag/AgCl microelectrode ($\phi$=0.1 mm) 5 coated with agar containing saturated KCl. A potential of the steel plate 2 with respect to the electrode 5 is outputted through a buffer to a computer for data collection.

When the apparatus is exposed under sunshine and the surface of the coated steel plate 2 is wetted with water, it has been confirmed from the potential of the defective part 4 that a current flows through the water film, and a corrosion protection current flows into the defective part 4 to prevent rusting.

Further, with the anode 3 applied with a voltage of 7.5V by the solar battery 1, when potential of the artificial defective part 4 located about 2 m apart from the anode 3 is measured, the potential is within the range from −800 mV to −900 mV, confirming that perfect corrosion protection can be achieved since carbon steel enters an inactive region at −650 mV.

(ii) In the experimental apparatus of (i), when sunshine decreases, the potential of the artificial defective part 4 is not decreased to the corrosion protection range. Therefore, next, a circuit combined with a secondary battery as shown in FIG. 2 is constructed and experiment is carried out.

As the secondary battery, five 1.2 V nickel-cadmium batteries 6 are used which are connected in series to obtain a voltage of 6V. In the figure, reference numeral 7 is a coating film surface of the coated steel plate 2, and 8 is a water film formed on the coating film surface 7.

With this experimental apparatus, after an exposure test is carried out for 60 days, including rain falls and nights, it has been found that potential of the artificial defective part 4 indicates −760 mV to −880 mV, thus achieving corrosion protection. Since power drop of the secondary battery 6 during the test has been very little, consumption current can be presumed to be about 20 to 40 $\mu$A.

(iii) When the total apparatus including the secondary battery, the solar battery, and the aluminum anode is constructed compact, and a service life of a minimum of about 10 years is aimed, it is particularly required that to achieve 4000 charge-and-discharge cycles of the secondary battery, a discharge depth is suppressed to less than 30% and a control function for preventing overcharge is provided.

On the other hand, as a result of various trials and errors, a system of FIG. 3 shown in the embodiment below has been constructed and accomplished a technology.

In first aspect, the present invention relates to a simplified cathodic corrosion protection method for metal structure comprising the steps of: mounting an anode on a coated surface of a metal structure exposed to the atmosphere; connecting a cathode to a main body of the metal structure; connecting the anode and the cathode to a solar battery; whereby when a defective part is generated on the coated surface of the metal structure and water film is formed on the coated surface, establishing a corrosive condition of the metal structure, a current is automatically flowed between the anode and the cathode to prevent corrosion of the metal structure.

Here, instability of output of the solar cell may be compensated for by a long-life secondary rechargeable battery. And, the current may be applied under a constant voltage.

In second aspect, the present invention relates to a simplified cathodic corrosion protection apparatus for a metal structure characterized by comprising at least: an anode mounted on a coated surface of a metal structure exposed to the atmosphere; a cathode connected to a main body of the metal structure; a solar battery connecting the anode and the cathode to output terminals of itself, wherein when a defective part is generated on the coated surface of the metal structure and water film is formed on the coated surface, establishing a corrosive condition of the metal structure, a current is automatically flowed between the anode and the cathode to prevent corrosion of the metal structure.

Here, the apparatus may further comprise a long-life secondary rechargeable battery for compensating for instability of output of the solar battery in addition to the solar battery and storing when electric power produced by the solar battery is in excess, as the current supply source. And, the current may be applied under a constant voltage.

In third aspect, the present invention relates to a simplified cathodic corrosion protection apparatus for a metal structure characterized by comprising at least: a plate-formed having a recess opening on an upper surface and formed at the center with a round hole opening at a bottom surface, a solar battery connecting its anode to the recess and encased in the recess, and in the round hole a needle-like cathode urged by an urging member to protrude outward and connected with cathode of the solar battery.

Here, the apparatus may further comprise a long-life secondary rechargeable battery as a current supply source disposed in the recess in addition to the solar battery for compensating for instability of output of the solar battery and storing when electric power produced by the solar battery is in excess.

And, an insulating adhesive layer for fixing the metal structure may be formed on a bottom surface of the plate-formed anode.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments according to the present invention will be described below, however, the present invention are not limited to the these embodiments.

Figure 3:
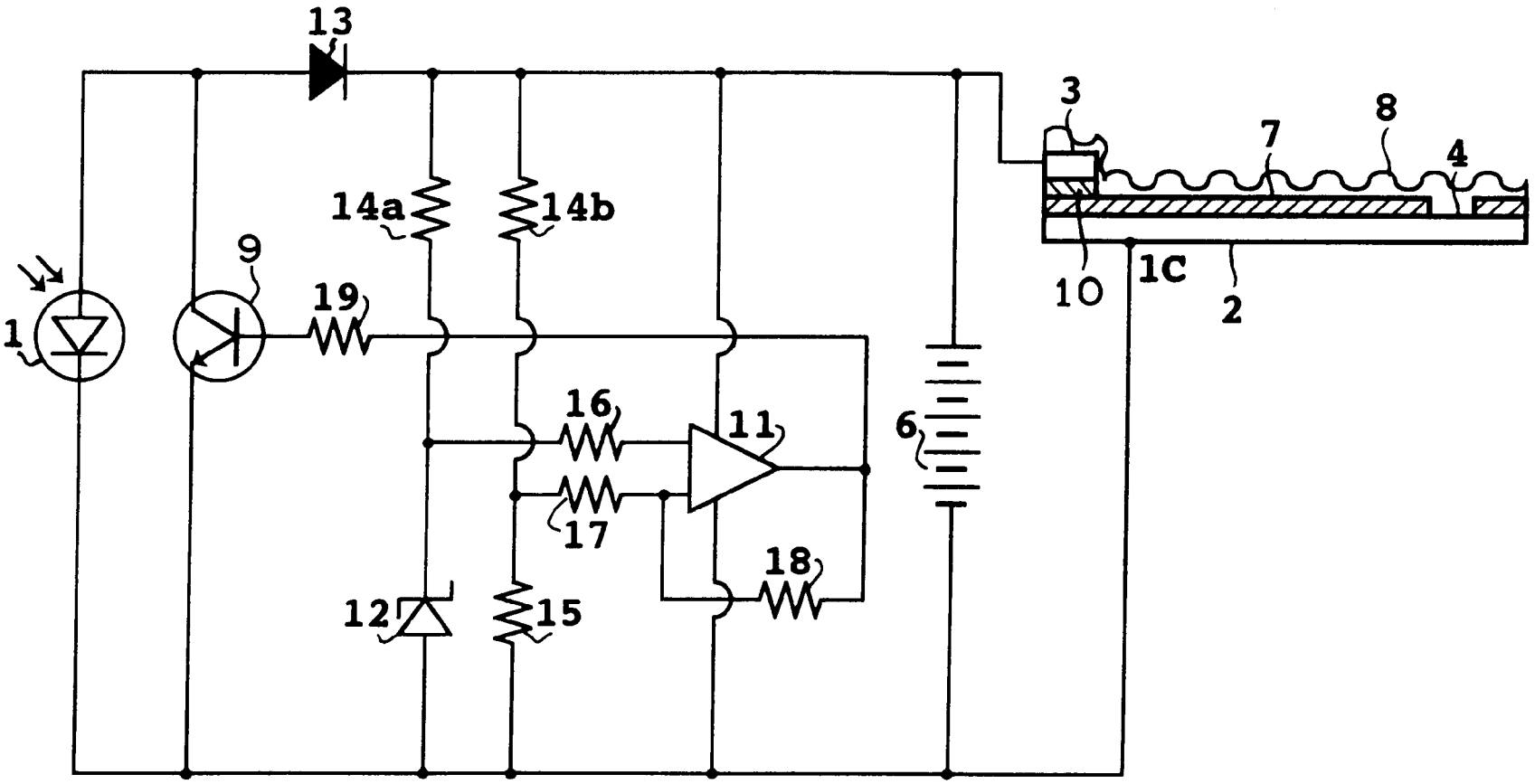
FIG. 3 is a circuit diagram for explaining an example of the simplified cathodic corrosion protection apparatus for a metal structure according to the present invention.

FIG. 3 is a circuit diagram of an apparatus suitable for realizing the simplified cathodic corrosion protection method for a metal structure according to the present invention.

In the present method, there is a defective part 4 in a coating 7 provided on a coated steel plate 2 which is a corrosion protected body, and an aluminum anode 3 is adhered onto the coated surface with an insulating adhesive 10. When humidity is about 60%, a water film 8 covers the coated steel plate 2, in which air pollutants or sea salt particles are dissolved to produce an aqueous electrolyte solution, constituting a condition for rust generation on the defective part 4. Against this, a corrosion protection current is supplied to the defective part 4 through the water film by a solar battery 1 and an auxiliary system to prevent rusting in the defective part 4. In the daytime, current supplied from the solar battery 1 charges a secondary battery 6 and, at the same time, the current is supplied from the anode 3 through the water film 8 to the defective part 4. When the secondary battery 6 becomes a fully charged state, to prevent the secondary battery 6 from being overcharged, an OP amplifier 11 detects voltage of the secondary battery 6, and then a transistor 9 operates to short-circuit an extra-current to the cathode of the solar battery 1.

A Zener diode 12, even when the voltage of the secondary battery 6 fluctuates, serves to maintain the voltage before and after operation at a constant value and assist detection of the OP amplifier 11. In the night, when current from the solar battery 1 is zero, discharge current from the secondary battery 6 is blocked not to flow back to the solar battery 1 so as to flow from the anode 3 through the water film 8 into the defective part 4. In FIG. 3, reference numerals 14*a*, 14*b*, 15, 16, 17, 18, and 19 are resistors for stabilizing the system.

As the apparatus, the solar battery, the control system, the secondary battery, and the anode nay be integrated in a compact structure which is stuck onto the coated surface of the corrosion protected body, and a wiring work is not necessary. There are several types, of which an example is shown in FIG. 4.

Figure 4:
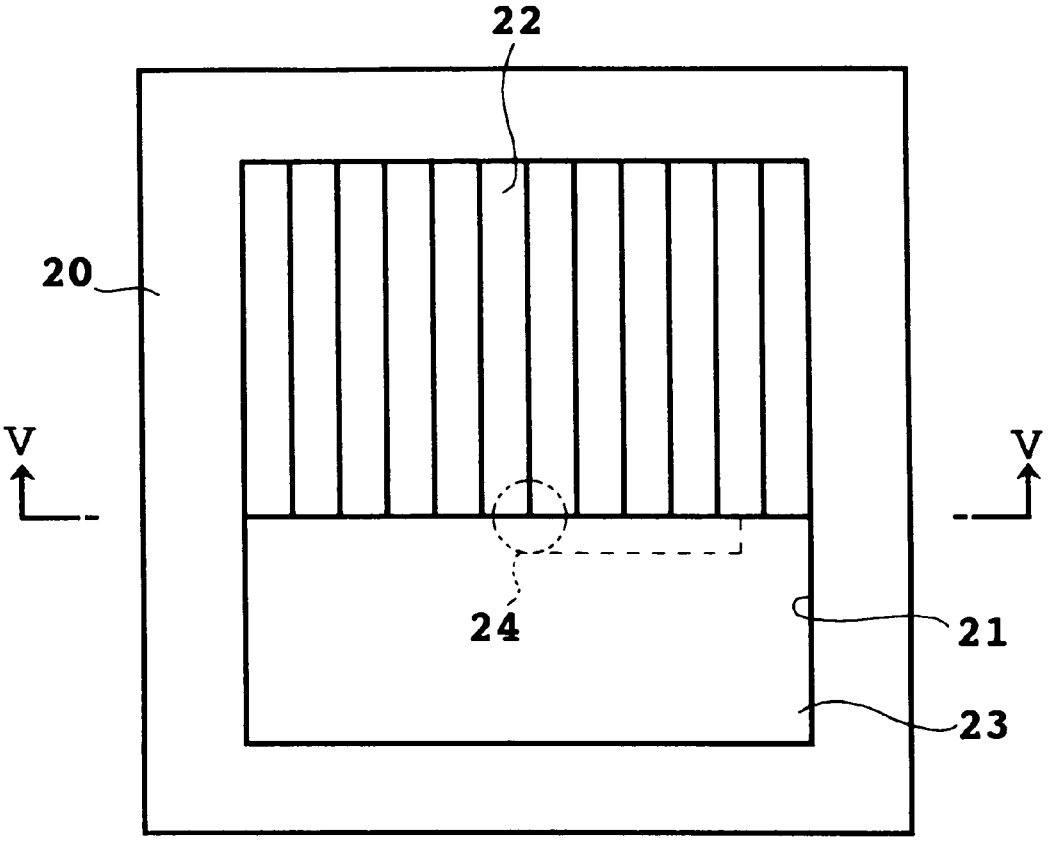
FIG. 4 is a schematic plan diagram when the simplified cathodic corrosion protection for a metal structure according to the present invention is constructed in a compact integrated type.
Figure 5:
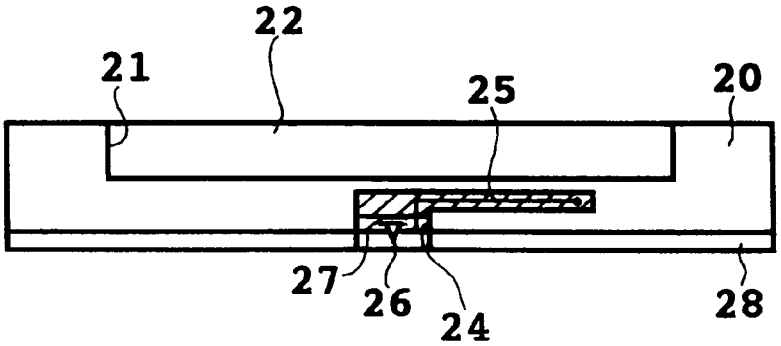
FIG. 5 is a schematic sectional diagram taken along line A—A in FIG. 4.

In FIG. 4 and FIG. 5, reference numeral 20 indicates a plate-formed aluminum anode, in a recess 21 opening on an upper surface of which is mounted a control system board 23 including a solar battery 22 and a secondary battery. Further, at the center of the plate-formed anode 20, a round hole 24 opening at a bottom surface is formed.

On the other hand, a rugged needle-like cathode 26 connected with a cathode wire of the control system of the board 23 is welded to a spring 27, and the spring 27 is set in position with a resin so that the tip of the needle-like cathode 27 protrudes on the lower surface of an insulating two-sided adhesive 28 stuck to the bottom surface of the anode 20 through the round hole 24.

As described above, the insulating two-sided adhesive 28 is stuck onto the bottom surface of the anode 20, when it is stuck onto a coating film of corrosion protected body such as a coated steel plate, the protective film on the, lower surface of the adhesive 28 may be removed by hand, the anode 20, the solar battery 22, and the control system board 23 be pressed thereto, thus corrosion protection of an outdoor structure can be simply achieved.

When the present apparatus is pressed against a coated surface, the tip of the needle-like cathode 26 penetrates the coating film to reach the base material, thereby establishing conductivity.

Figure 1:
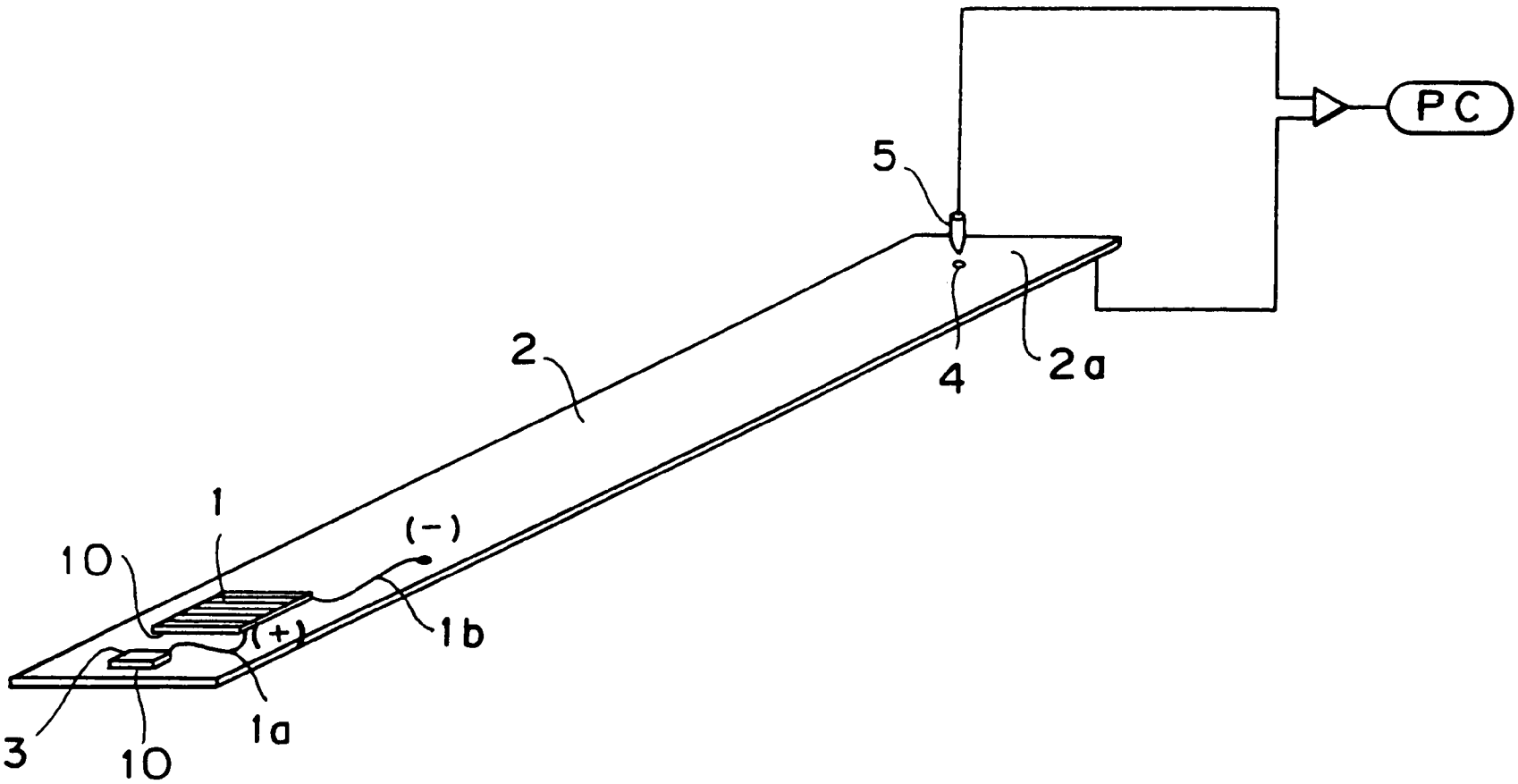
FIG. 1 is a schematic perspective diagram for explaining a basic structure of a simplified cathodic corrosion protection apparatus for a metal structure according to the present invention.
Figure 2:
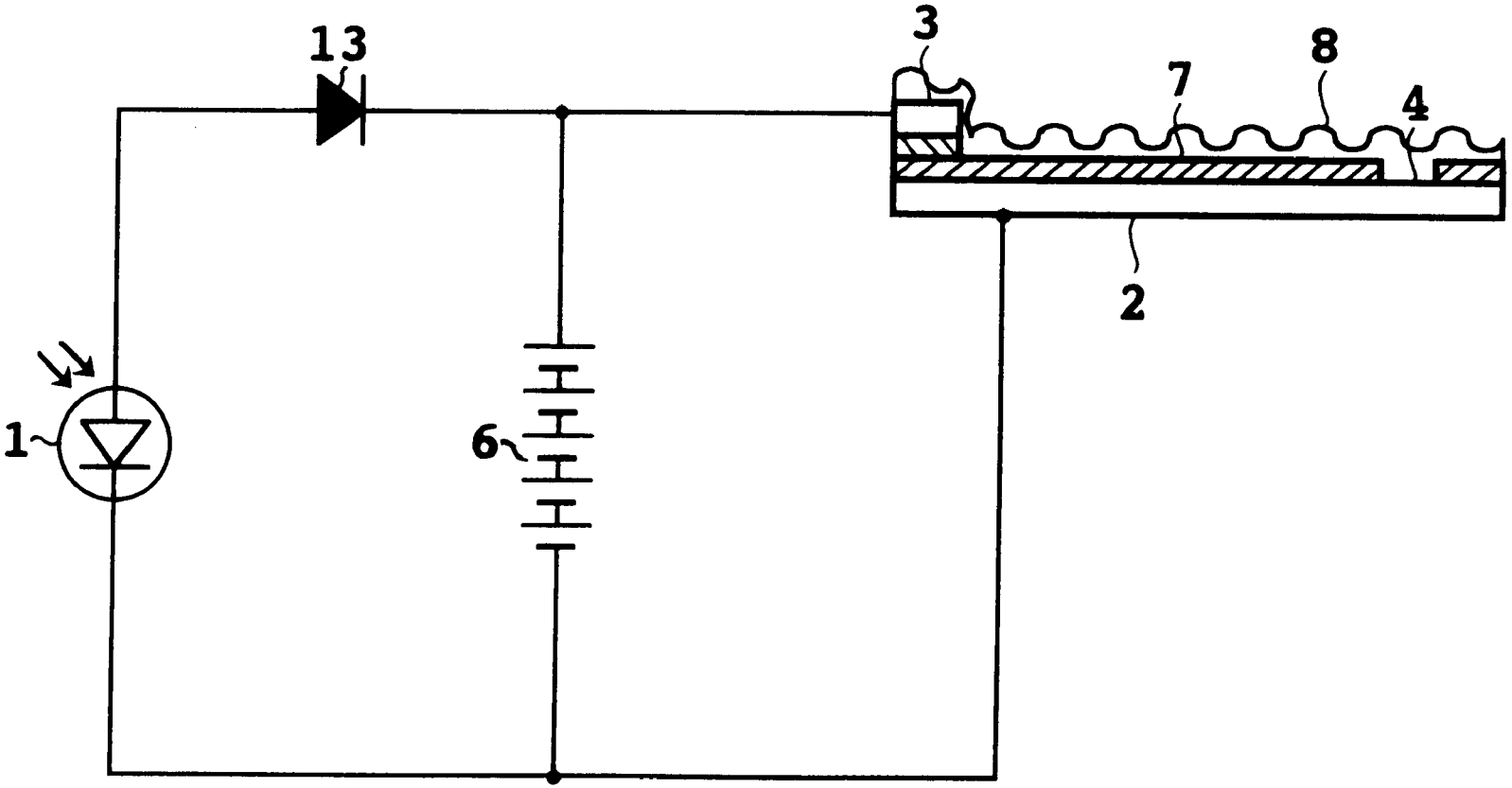
FIG. 2 is a schematic diagram for explanation including a circuit diagram of a corrosion protection apparatus improved by incorporating a secondary battery in the corrosion protection apparatus of FIG. 1.

The present apparatus is stuck onto a test steel plate (in the coating, a urethane resin paint used as a primer and a thermosetting water-soluble acrylic resin paint used as a top coating) as shown in FIG. 1, and subjected to a corrosion protection test. In an environment where the humidity exceeds 60% and a water film is formed throughout a year by day and night, that is, in a corrosive environment, it has been confirmed that the potential of the artificial defective part of the steel plate can be maintained at a corrosion protection potential. Further, a substantial rust generation in the artificial defective part is not noted. In the above construction, it is important that the placement location of the secondary battery is appropriately selected in a low temperature position as possible according to the operation environment, for example, in a space part on the backside of the solar battery.

Corrosion protection of a metal structure can be ensured by sticking thin, compact, lightweight; plate-formed corrosion protection apparatus integrating the solar cell, the anode, and the control system, at intervals of 4 to 8 m onto the metal structure exposed to the atmosphere. With wide application of the present apparatus, large amounts of painting work costs can be considerably reduced, with immeasurable economic effects. Moreover, unlike prior art electrical corrosion protection, the present invention does not require material and labor consuming work such as wiring, or use of an external power supply, not only with a remarkable advance in economic effect but also with increased significance in safety. The present; invention also features that a constant optimum voltage can be applied to the anode, which is different from the prior art method.

In a remote place where no power supply equipment is available such as a power distribution line, simple and economical corrosion protection can be indispensably achieved by using the present apparatus.

The present invention has been described in detail with respect to preferred embodiments, and it will now be that changes and modifications may be made without departing from the invention in its broader aspects, and it is the invention, therefore, in the appended claims to cover all such chancres and modifications as fall within the true sprit of the invention.

We claim:

1. A simplified cathodic corrosion protection method for a metal structure comprising the steps of:

mounting an anode on a coated surface of a metal structure exposed to the atmosphere;

connecting a cathode to a main body of said metal structure;

connecting said anode and said cathode to a solar battery;

wherein when a defective part is generated on said coated surface of said metal structure and water film is formed on said coated surface, establishing a corrosive condition of said metal structure, a current is automatically flowed between said anode and said cathode to prevent corrosion of said metal structure.

2. The simplified cathodic corrosion protection method for a metal structure as claimed in claim 1, wherein instability of output of said solar cell is compensated for by a long-life secondary rechargeable battery.

3. The simplified cathodic corrosion protection method for a metal structure as claimed in claim 2, wherein said current is applied under a constant voltage.

4. The simplified cathodic corrosion protection method for a metal structure as claimed in claim 1, wherein said current is applied under a constant voltage.

5. A simplified cathodic corrosion protection apparatus for a metal structure characterized by comprising at least:

an anode mounted on a coated surface of a metal structure exposed to the atmosphere;

a cathode connected to a main body of said metal structure;

a solar battery connecting said anode and said cathode to output terminals of itself, wherein when a defective part is generated on said coated surface of said metal structure and water film is formed on said coated surface, establishing a corrosive condition of said metal structure, a current is automatically flowed between said anode and said cathode to prevent corrosion of said metal structure.

6. The simplified cathodic corrosion protection apparatus for a metal structure as claimed in claim 5, further comprising a long-life secondary rechargeable battery for compensating for instability of output of said solar battery in addition to said solar battery and storing when electric power produced by said solar battery is in excess, as said current supply source.

7. A simplified cathodic corrosion protection apparatus for a metal structure characterized by comprising at least:

a plate-formed having a recess opening on an upper surface and formed at the center with a round hole opening at a bottom surface, a solar battery connecting its anode to said recess and encased in said recess, and in said round hole a needle-like cathode urged by an urging member to protrude outward and connected with cathode of said solar battery.

8. The simplified cathodic corrosion protection apparatus for a metal structure as claimed in claim 7, further comprising a long-life secondary rechargeable battery as a current supply source disposed in said recess in addition to said solar battery for compensating for instability of output of said solar battery and storing when electric power produced by said solar battery is in excess.

9. The simplified cathodic corrosion protection apparatus for a metal structure as claimed in claim 8, wherein an insulating adhesive layer for fixing said metal structure is formed on a bottom surface of said plate-formed anode.

10. The simplified cathodic corrosion protection apparatus for a metal structure as claimed in claim 7, wherein an insulating adhesive layer for fixing said metal structure is formed on a bottom surface of said plate-formed anode.

* * * * *

UNITED STATES PATENT AND TRADEMARK OFFICE

CERTIFICATE OF CORRECTION

PATENT NO. : 5,954,938

DATED : Sep. 21, 1999

INVENTOR(S) : Masahiro Takahashi; Yasuhiko Takahashi

It is certified that error appears in the above-identified patent and that said Letters Patent are hereby corrected as shown below:

Col. 1, line 27, before "of" change "output" to --Output--

Col. 1, line 46, before "there" change "if" to --If--

Col. 2, line 6, change "an,artificial" to --an artificial--

Col. 2, line 52, after "In" insert --the--

Col. 3, line 1, after "In" insert --the--

Col. 3, line 19, after "In" insert --the--

Col. 3, line 27, before "cathode" insert --the--

Col. 3, line 66, after "invention" change "are" to --is--

Col. 4, line 22, after "detects" insert --the--

Col. 4, line 35, change "nay" to --may--

Col. 4, line 37, after "body," delete "and"

Col. 4, line 54, change "anode 20, when" to --anode 20. When--

Col. 4, line 57, after "the" delete the comma

Col. 4, line 60, after "23" insert --may then--

UNITED STATES PATENT AND TRADEMARK OFFICE

CERTIFICATE OF CORRECTION

PATENT NO. : 5,954,938

DATED : Sep. 21, 1999

INVENTOR(S) : Masahiro Takahashi; Yasuhiko Takahashi

It is certified that error appears in the above-identified patent and that said Letters Patent are hereby corrected as shown below:

Col. 5, line 27, after "present" delete the semicolon

Col. 5, line 39, before "and" change "chancres" to --changes--

Signed and Sealed this

First Day of May, 2001

*Attest:*

Nicholas P. Godici

NICHOLAS P. GODICI

*Attesting Officer*

*Acting Director of the United States Patent and Trademark Office*